US006910281B2

(12) United States Patent
Ito

(10) Patent No.: US 6,910,281 B2
(45) Date of Patent: Jun. 28, 2005

(54) HAIR DRIER WITH MINUS ION PRODUCER

(75) Inventor: Kengo Ito, Hikone (JP)

(73) Assignee: Matsushita Electric Works, Ltd., Kadoma (JP)

( * ) Notice: Subject to any disclaimer, the term of this patent is extended or adjusted under 35 U.S.C. 154(b) by 107 days.

(21) Appl. No.: 10/432,593

(22) PCT Filed: Dec. 21, 2001

(86) PCT No.: PCT/JP01/11284

§ 371 (c)(1),
(2), (4) Date: Jun. 2, 2003

(87) PCT Pub. No.: WO02/051282

PCT Pub. Date: Jul. 4, 2002

(65) Prior Publication Data

US 2004/0020070 A1 Feb. 5, 2004

(30) Foreign Application Priority Data

Dec. 25, 2000 (JP) ..... 2000-393893

(51) Int. Cl.[7] ..... A45D 20/00

(52) U.S. Cl. ..... 34/96; 34/96; 392/380; 219/222

(58) Field of Search ..... 34/96, 97, 98, 34/99; 392/379, 380; 219/222; 132/118, 221

(56) References Cited

U.S. PATENT DOCUMENTS

| | | | |
|---|---|---|---|
| 3,582,711 A | 6/1971 | Jahnke | |
| 5,612,849 A | 3/1997 | Prehodka et al. | |
| 5,805,406 A | 9/1998 | Mailand | |
| 6,191,930 B1 | 2/2001 | Ramchandani | |

FOREIGN PATENT DOCUMENTS

| | | | |
|---|---|---|---|
| GB | 2 067 071 A | | 7/1981 |
| JP | 56-1482 | | 1/1981 |
| JP | 3013038 | | 6/1995 |
| JP | 8-47415 | | 2/1996 |
| JP | 385/1997 | | 7/1997 |
| JP | 2003070526 A | * | 3/2003 |
| KR | 1993-0005393 | | 8/1993 |
| KR | 96-0033346 | | 11/1996 |
| KR | 20-0206082 | | 12/2000 |

* cited by examiner

*Primary Examiner*—Jiping Lu
(74) *Attorney, Agent, or Firm*—Oblon, Spivak, McClelland, Maier & Neustadt, P.C.

(57) ABSTRACT

A hair drier having the capability of efficiently supplying hot air and minus ions from different outlets is provided. This hair drier has a hollow housing with an air suction inlet and an air outlet. In the housing, a fan and a heater are disposed in an air-flow channel formed between the air suction inlet and the air outlet. The air sucked in the housing by the fan is heated by the heater, and then ejected from the air outlet. The housing also has an ion-flow channel formed as an independent flow channel from the air-flow channel, and an ion outlet provided at a different position from the air outlet to eject minus ions generated by the minus ion generator. The minus ion generator is disposed in the ion-flow channel.

9 Claims, 5 Drawing Sheets

HAIR DRIER WITH MINUS ION PRODUCER

TECHNICAL FIELD

The present invention relates to a hair drier with a minus ion generator, which has the capability of efficiently supplying minus ions to hair, while drying or setting the hair with hot air.

BACKGROUND ARTS

In general, it is said that hair is easy to be positively charged. When minus ions, which are minute water in the air coupled with negatively charged oxygen, contact the positively-charged hair, a styling of the hair can be easily performed, while moisture content of the hair being kept. Therefore, it is proposed to place a minus ion generator in a hair drier or a styling brush.

For example, a conventional hair drier with the minus ion generator is of a structure shown in FIG. 5. That is, an air-flow channel 2 is formed in a tubular housing 1 of this hair drier, so that air sucked from an air-suction inlet 22 provided at one end of the housing 1 is ejected from an air outlet 21 provided at the other end thereof. In the air-flow channel 2 of the housing 1, a fan 31, motor 32 for driving the fan, heater 33, and the minus ion generator 7 are disposed. In FIG. 5, the numeral 34 designates a grid member 34 attached to the air outlet 21 to prevent foreign matter from getting into the housing 1. The numeral 4 designates a nozzle attached to the air outlet, which has a tapered shape to eject the air flow from its top end opening 41. In addition, a grip 35 projects downwardly from the housing 1, in which electric cords A for supplying electricity to the motor 32 and a power switch 36 are incorporated.

To use the above-described hair drier, when the power switch 36 is turned on, electric power is supplied to the motor 32, heater 33, and the minus ion generator 7. The air is sucked into the housing 1 from the air-suction inlet 22 by the fan 31, and then sent to the downstream side of the air-flow channel. Subsequently, the air in the air-flow channel 2 is heated by the heater 33. The heated air is mixed with the minus ions generated by the minus ion generator 7. Thus, the air flow including the minus ions is ejected outside from the opening 41 of the nozzle 4 through the air outlet 21 with the grid member 34.

However, the hair drier described above has a problem that the ion generator 7 disposed in the air-flow channel 2 hampers a flow of air in the air-flow channel 2. In addition, since some of the minus ions generated by the ion generator 7 are caught by the grid member 34, electrical repulsion occurs between the minus ions caught by the grid member 34 and minus ions in the air flow successively supplied, so that it becomes difficult for the minus ions to pass the grid member 34. Consequently, there is another problem that the supply amount of the minus ions gradually decreases.

SUMMARY OF THE INVENTION

In consideration of the above problems, a concern of the present invention is to provide a hair drier with a minus ion generator, which has the capability of efficiently supplying minus ions generated by the minus ion generator to hair, without hampering a flow of air in an air-flow channel.

That is, the hair drier of the present invention is characterized by comprising an air-flow channel formed in the interior of a housing; a fan and a heater disposed in the air-flow channel; an air outlet for ejecting an air, which is provided at a downstream end of the air-flow channel; an ion-flow channel formed in the housing so as to be separated from the air-flow channel; the minus-ion generator for generating minus ions, which is disposed in the ion-flow channel; and an ion outlet for the minus ions, which is provided at a downstream end of the ion-flow channel.

More specifically, the hair drier of the present invention is characterized by comprising a housing having a substantially hollow structure, which has an air suction inlet, air outlet, and an air-flow channel extending therebetween; a fan for sucking an outside air into the housing through the air suction inlet; a heater for heating the air in the air-flow channel; and the minus ion generator; wherein the housing has an ion-flow channel formed as an independent flow channel from the air-flow channel, and an ion outlet provided at a different position from the air outlet to eject minus ions generated by the minus ion generator, and wherein the minus ion generator is disposed in the ion-flow channel.

According to the hair drier described above, since the minus ions generated by the ion generator are stably supplied from the ion outlet, without being caught by an obstacle such as a grid member, a user can efficiently carry out hair styling by spraying the minus ions to the hair.

To achieve the concern described above of the present invention, it is preferred that the minus ion generator includes a needle electrode and a ground electrode spaced away from the needle electrode by a small distance, and a discharge for generating the minus ions is developed between the needle electrode and the ground electrode by applying a negative high voltage to the needle electrode.

In addition, it is preferred that the housing has an air induction path for allowing part of the air running in the air-flow channel to flow in the ion-flow channel. In this case, it is possible to more stably supply the minus ions together with the air that comes into the air induction path. Moreover, since it is not needed to dispose an additional fan in the housing in order to eject the minus ions generated by the minus ion generator from the ion outlet, there are advantages that the hair drier becomes a simple structure as whole, and can be easily downsized. Additionally, as compared with a hair drier with a dedicated fan, power consumption can be reduced.

In addition, it is preferred that the ion outlet is provided in the vicinity of the air outlet. In this case, since the minus ions ejected from the ion outlet are easily mixed with the hot air ejected from the air outlet, it is effective to increase amounts of the minus ions that reach the user's hair. Moreover, there are advantages of preventing a hair damage caused by over-drying and decreasing the occurrence of static electricity.

In addition, it is preferred that the above-described hair drier has an ion switch for switching the minus ion generator to start or stop generating the minus ions. In this case, since the user can control the presence or absence of the minus ions, it is possible to supply the hot air with the minus ions to the hair as need arises. For example, when moist hair is desired, the ion switch is turned on, and when a hairstyle with volume is desired, the ion switch is turned off. In particular, when the ion switch is provided on a surface of the housing and in the vicinity of the minus ion generator, it is possible to easily select the presence or absence of the minus ions by operating the ion switch by one hand, while holding the grip of the hair drier by the other hand.

In addition, it is preferred that the hair drier described above has an ion generation indicator for indicating the start or stop of generating the minus ions by the minus ion generator in conjunction with the ion switch. In particular, it is preferred that the ion-generation indicator is provided on a surface of the housing and in the vicinity of the minus ion generator. In this case, it is possible to easily check the presence or absence of generating the minus ions.

These and still other objects and advantages of the present invention will become more apparent from the best mode for carrying out the present invention explained below, referring to the attached drawings.

BEST MODE FOR CARRYING OUT THE INVENTION

Referring to the attached drawings, a hair drier with a minus ion generator according to a preferred embodiment of the present invention is explained below in detail.

Figure 1:
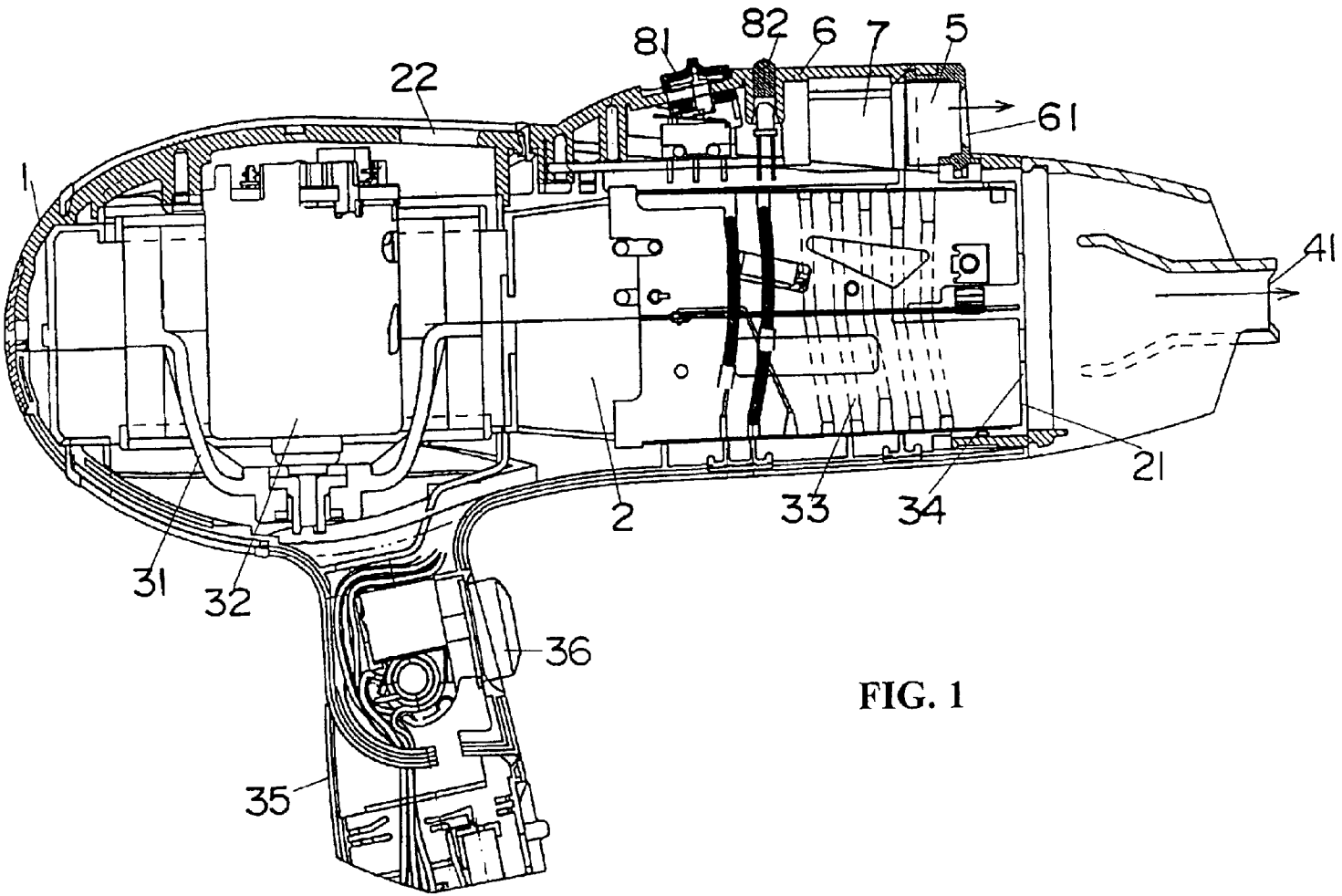
FIG. 1 is a longitudinal cross-sectional view of a hair drier with a minus ion generator according to a preferred embodiment of the present invention.

As shown in FIG. 1, this hair drier is mainly composed of a hollow housing 1 having an air suction inlet 22, air outlet 21, and an air-flow channel 2 formed therebetween, and a grip 35, in which a power switch 36 of the drier is disposed.

In this embodiment, the air suction inlet 22 is provided with a main suction inlet 25 formed in an upper surface of the housing and an auxiliary suction inlet 26 formed in a lower surface thereof. In the housing 1, the air-flow channel 2 is defined between the air suction inlet 22 and the air outlet 21. A fan 31 for sucking an outside air from the air suction inlet 22 into the housing and a heater 33 for heating the air in the air-flow channel are disposed in the air-flow channel 2. In the drawings, the numeral 32 designates a motor for driving the fan 31. By driving the fan 31, the air sucked in the housing 1 is heated by the heater 33, so that the obtained hot air is ejected from the air outlet 21.

The fan 31 is of a centrifugal type of taking the air from the main and auxiliary suction inlets 25, 26 into the housing 1, and ejecting the air from the air outlet 21 provided at the opposite side of the air-flow channel 2. Since the air flows in the housing from the top and bottom thereof, a smooth air flow can be achieved. The air suction inlet 22 may be provided with only the main suction inlet 25.

A net-like grid member 34 for preventing inhalation of foreign substance into the housing 1 is attached to the air outlet 21. A nozzle 4 for collecting the air flow in the housing 1 and ejecting it to the outside is also attached to the air outlet 21. The nozzle 4 is formed in such a tapered shape that its aperture diameter decreases toward an end aperture 41 of the nozzle 4. In addition, a pair of wings 42 are formed in the nozzle to collect the flow of air in a direction of a substantially center axis of the housing. This pair of the wings 42 are formed such that air flows ejected from clearances between the respective wings and an interior surface of the nozzle are joined to the air flow ejected from a space between the wings. Thereby, as compared with the case of using a nozzle having a simple tapered shape, the hot air can be efficiently collected in the direction of the substantially center axis of the housing to further increase a velocity of the air flow. In the hair drier of the present embodiment, a path extending from the air suction inlet 22 of the housing 1 to the end aperture 41 of the nozzle 4 through the air outlet 21 corresponds to the air-flow channel 2 of the hair drier.

The grip 35 is integrally formed with the housing 1 so as to extend downwardly from the housing surface at a side of the auxiliary suction inlet 26. The grip 35 is of a substantially tubular shape, in which a motor 32 and a power switch 36 for the heater 33 are disposed.

Figure 2:
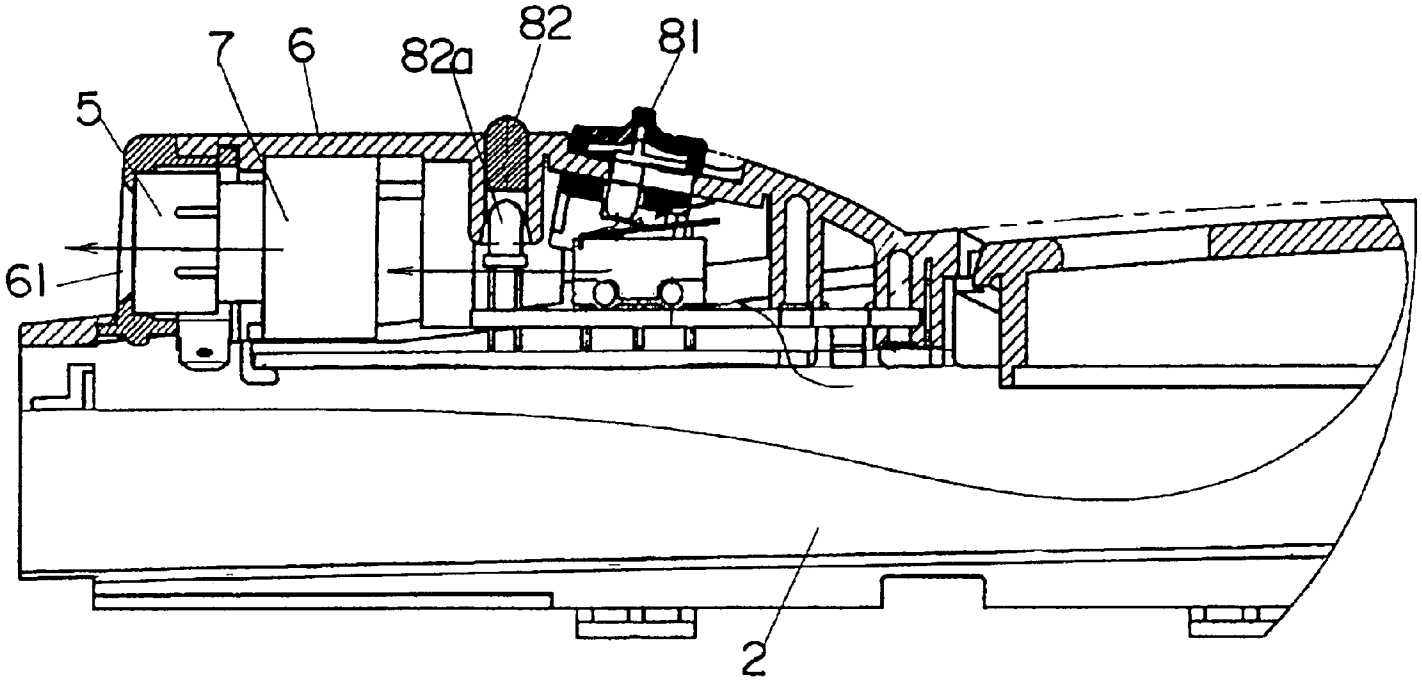
FIG. 2 is an enlarged cross-sectional view illustrating an ion flow channel of the hair drier of FIG. 1.

In the present invention, as shown in FIG. 2, the minus ion generator 7 is disposed at an upper side in the housing 1. As explained in detail below, minus ions generated by the minus ion generator 7 are ejected to the outside through an ion-flow channel 5 independently formed from the air-flow channel 2, and an ion outlet 61 provided at a different position from the air outlet 21.

Figure 3:
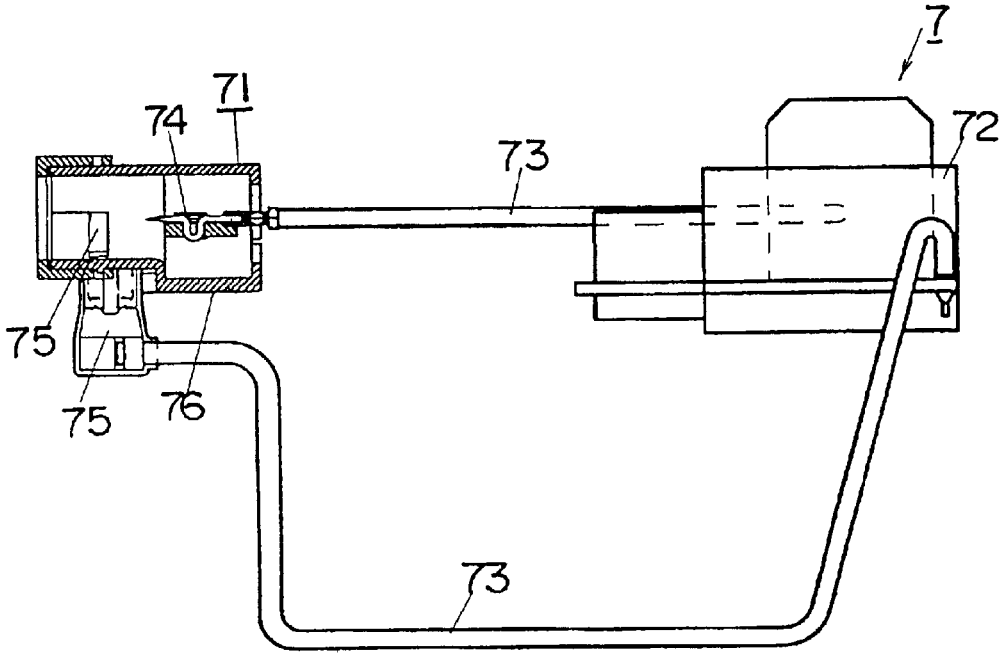
FIG. 3 is a schematic diagram of a structure of the minus ion generator.

The minus ion generator 7 generates the minus ions that are minute moisture in the air coupled with negatively-charged oxygen. As shown in FIG. 3, the minus ion generator 7 is composed of a discharge unit 71, a high voltage generator 72, and lead wires 73 electrically connecting therebetween. The discharge unit 71 comprises a needle-like electrode 74, ground electrode 75 spaced away from the needle-like electrode by a required distance, and a casing 76 made of an insulating material to hold these electrodes. The needle-like electrode 74 and the ground electrode 75 are respectively connected to the high voltage generator 72 by the lead wires 73.

To generate the minus ions by the minus ion generator 7, the high voltage generator 72 develops a voltage such that a negative high voltage is applied to the needle-like electrode 74 with reference to the ground electrode 75. Thereby, a corona discharge (approximately 5 KW) happens between the needle-like electrode 74 and the ground electrode 75 to generate the minus ions. The minus ion generator 7 is not limited to the above-described one. Another minus ion generator may be used.

Figure 4:
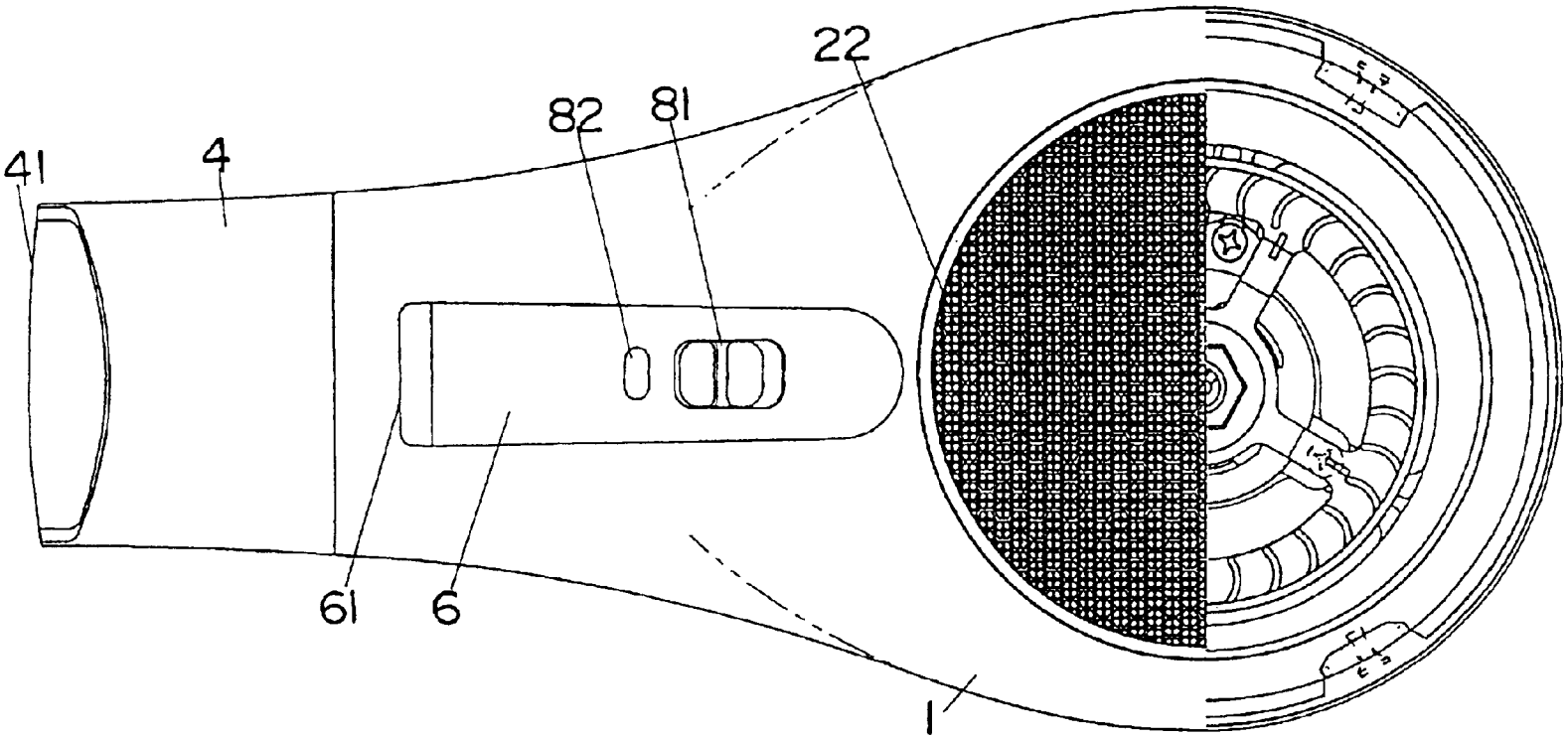
FIG. 4 is a partially cross-sectional top view of the hair drier of FIG. 1.
Figure 5:
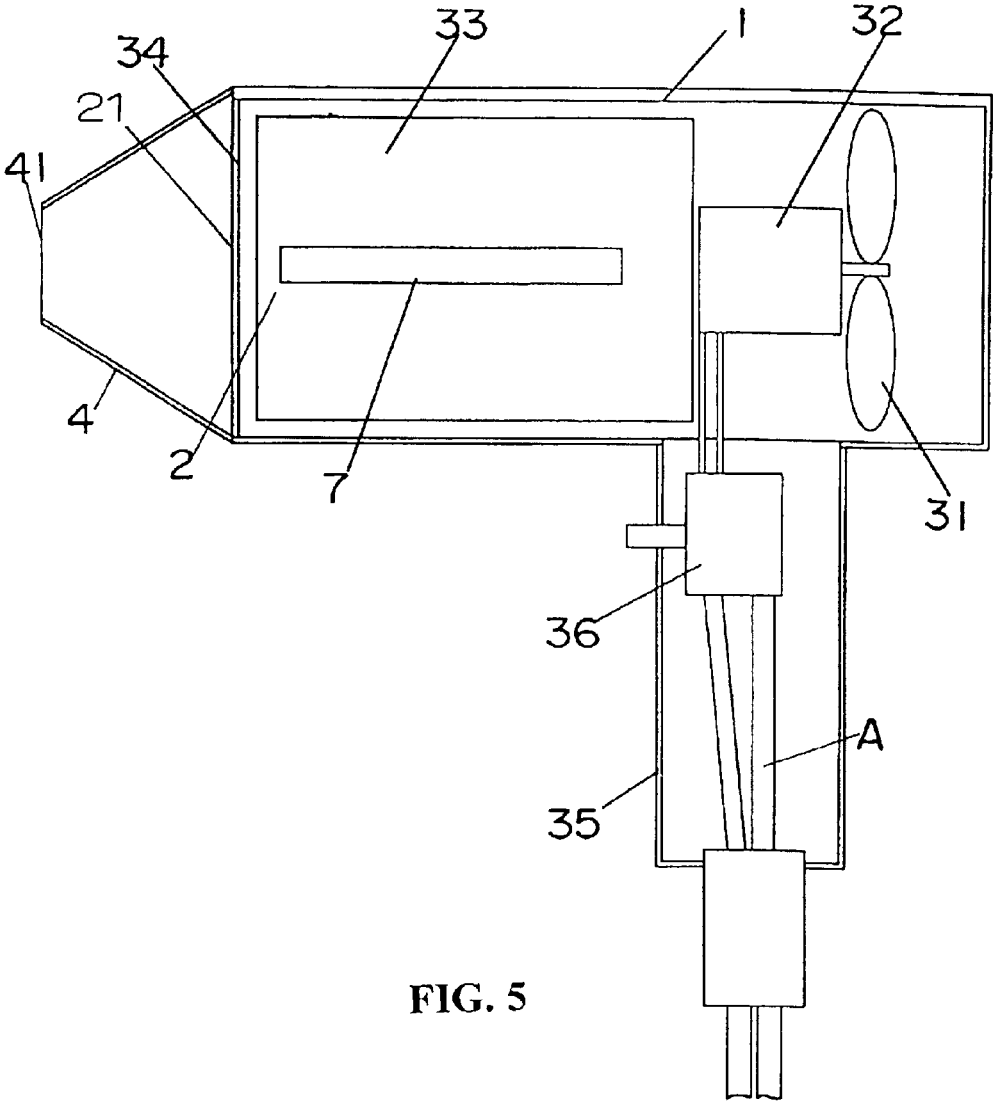
FIG. 5 is a schematic cross-sectional view of a conventional hair drier with a minus ion generator.

To place the ion generator 7 in the ion-flow channel 5, as shown in FIGS. 2 and 4, an outer wall 6 for the ion-flow channel is integrally formed with the housing 1 such that the outer wall is smoothly elevated forwardly from a substantially center portion of the upper surface of the housing 1, and an ion outlet 61 is opened in the same direction as the air outlet 21.

In this embodiment, at the downstream side of the ion generator 7, the ion-flow channel 5 is completely separated from the air-flow channel 2. However, at the upstream side of the ion generator 7, the ion-flow channel 5 is connected to the air-flow channel 2 though an air induction path 9 formed to allow part of the air running in the air-flow channel 2 to flow in the ion-flow channel 5. Thereby, as shown by the arrow in FIG. 2, the part of the air in the air-flow channel 2 passes the minus ion generator 7 though the air induction path 9, so that the minus ions generated by the ion generator 7 flows in the ion-flow channel 5 together with the part of the air flowed therein, and then supplied from the ion outlet 61.

When the minus ions are caught by the grid member 34 or the nozzle 4 placed in the air-flow channel 2 before the minus ions generated by the ion generator 7 are ejected from the ion outlet 61, a flow of the minus ions to the downstream side is hampered by electrical repulsion caused between the minus ions caught by the above-described member and minus ions in the air flow successively supplied. In the present invention, by forming the ion-flow channel 5 as an independent flow channel from the air-flow channel 2 in the housing 1, it is possible to avoid such an inconvenience that it becomes difficult to supply the minus ions from the ion outlet 61.

In addition, since the ion outlet 61 is provided in the vicinity of the air outlet 21, the minus ions ejected from the ion outlet 61 is mixed with the air ejected from the nozzle 4 attached to the air outlet 21, and then sprayed on the hair. As a result, it is possible to efficiently spray the minus ions on the hair by help of the flow of the heated air.

As described above, an important feature of the present invention is to independently provide the ion-flow channel 5 connecting to the ion outlet 61 from the air-flow channel 2 for sending the hot air to the air outlet 21. Therefore, the minus ions generated by the minus ion generator 7 can not come into the air-flow channel 2.

As shown in FIG. 2, an ion switch 81 for switching the minus ion generator 7 to start or stop generating the minus ions is provided at an upper surface of the outer wall 6 for the ion-flow channel. Thereby, it is possible to easily select the presence or absence of the generation of minus ions by operating the ion switch 81 by one hand, while holding the grip 35 of the hair drier by the other hand.

In addition, an ion generation indicator 82 is provided in proximity to the ion switch 81 to indicate the start or stop of the generation of minus ions by the minus ion generator 7 in conjunction with the ion switch 81. Therefore, when the ion switch 81 is operated, the presence or absence of the generation of minus ions can be checked by the ion generation indicator 82. This provides a further improvement in operationality of the hair drier of the present invention. In the present embodiment, an LED 82*a* is used as the ion generation indicator 82. Thus, since the function of controlling the air flow of the hair drier is located on the grip 35, and the function of operating the generation of the minus ions is located on the upper surface of the housing 1, it is possible to provide the hair drier having an improved operationality and a refined appearance.

The following is an example of how to use the hair drier described above. After a user washes hair, and wipes the wet hair with a towel lightly, it is preferred to dry the hair with a hot air, while spraying minus ions from the hair dryer of the present invention. That is, the grip 35 is grasped, and the power switch 36 is turned on to activate the motor 32 and rotate the fan 31. Thereby, outside air is sucked into the housing 1 through the air suction inlet 22, and the sucked air is heated by the heater 33 to provide the hot air.

The hot air is sent to the nozzle 4 through the grid member 34 disposed in the vicinity of the air outlet 21 of the housing 1, and then ejected from the end aperture 41 of the nozzle 4. To spray the minus ions together with the hot air on the hair, the ion switch 81 is turned on to generate the minus ions by the minus ion generator 7, so that the minus ions are ejected from the ion outlet 61. Thus, by drying the hair with the hot air containing the minus ions, it is possible to achieve moist hair that is easy to perform hairstyling.

INDUSTRIAL APLLICABILITY

According to the present invention, minus ions generated by the minus ion generator can be efficiently ejected from the ion outlet, without being caught by an obstacle such as a grid member in the housing. In addition, since the ion generator is disposed in the ion-flow channel other than the air-flow channel in the housing, it does not hamper a flow of the hot air running the air-flow channel. As a result, a user of the hair drier can perform hairstyling with freedom, while spraying larger amounts of the minus ions to the hair. Moreover, by an increase in the amounts of minus ions that reach the hair, it is possible to obtain the hair having high moisture content in less time. This achieves moist hair that is easy to perform hairstyling.

In particular, when the ion outlet is provided in the vicinity of the air outlet, the minus ions ejected from the ion outlet are mixed with the hot air ejected from the air outlet, and then supplied to the user's hair. Therefore, the amounts of minus ions spayed on the hair can be further increased.

What is claimed is:

1. A hair drier with a minus ion generator comprising:

an air-flow channel formed in the interior of a housing;

a fan and a heater disposed in said air-flow channel;

an air outlet for ejecting an air, which is provided at a downstream end of said air-flow channel;

an ion-flow channel formed in said housing so as to be separated from said air-flow channel;

said minus-ion generator for generating minus ions, which is disposed in said ion-flow channel; and an ion outlet for said minus ions, which is provided at a downstream end of said ion-flow channel.

2. The hair drier as set forth in claim 1, wherein said minus ion generator includes a needle electrode and a ground electrode spaced away from said needle electrode by a small distance, and wherein a discharge for generating said minus ions is developed between said needle electrode and said ground electrode by applying a negative high voltage to said needle electrode.

3. The hair drier as set forth in claim 1, wherein said housing has an air induction path for allowing part of the air running in said air-flow channel to flow in said ion-flow channel.

4. The hair drier as set forth in claim 1, wherein said ion outlet is provided in the vicinity of said air outlet.

5. The hair drier as set forth in claim 1 comprising an ion switch for switching said minus ion generator to start or stop generating said minus ions.

6. The hair drier as set forth in claim 5, wherein said ion switch is provided on a surface of said housing and in the vicinity of said minus ion generator.

7. The hair drier as set forth in claim 5 comprising an ion generation indicator for indicating the start or stop of generating said minus ions by said minus ion generator in conjunction with said ion switch.

8. The hair drier as set forth in claim 7, wherein said ion-generation indicator is provided on a surface of said housing and in the vicinity of said minus ion generator.

9. A hair drier with a minus ion generator comprising:

a housing having a substantially hollow structure, which has an air suction inlet, air outlet, and an air-flow channel extending therebetween;

a fan for sucking an outside air into said housing through said air suction inlet;

a heater for heating the air in said air-flow channel; and said minus ion generator;

wherein said housing has an ion-flow channel formed as an independent flow channel from said air-flow channel, and an ion outlet provided at a different position from said air outlet to eject minus ions generated by said minus ion generator, and wherein said minus ion generator is disposed in said ion-flow channel.

* * * * *